United States Patent [19]

Dillenberg

[11] 4,093,522

[45] June 6, 1978

[54] ELECTROLYTIC CHROMIC ACID BATH FOR CHROME PLATING

[76] Inventor: Horst Dillenberg, Kaiser-Wilhelm-Allee 26, 56 Wuppertal 1, Germany

[21] Appl. No.: 641,607

[22] Filed: Dec. 17, 1975

[30] Foreign Application Priority Data

Jan. 10, 1975 Germany ..... 2500730

[51] Int. Cl.[2] ..... C25D 3/10

[52] U.S. Cl. ..... 204/51; 204/DIG. 2

[58] Field of Search ..... 204/DIG. 2, 51

[56] References Cited

U.S. PATENT DOCUMENTS

| | | | |
|---|---|---|---|
| 2,750,335 | 6/1956 | Brown et al. | 204/51 |
| 2,750,337 | 6/1956 | Brown et al. | 204/51 |
| 3,423,297 | 1/1969 | VanderHorst | 204/51 |
| 3,432,408 | 3/1969 | Brown et al. | 204/51 |
| 3,654,101 | 4/1972 | Aoun | 204/51 |
| 3,833,485 | 9/1974 | Crowther et al. | 204/43 R |

FOREIGN PATENT DOCUMENTS

| | | | |
|---|---|---|---|
| 1,229,625 | 9/1960 | France | 204/51 |
| 1,153,972 | 6/1969 | United Kingdom | 204/51 |

*Primary Examiner*—F.C. Edmundson

[57] ABSTRACT

Electrolytic chromic acid bath for fissured chrome plating is based upon hexavalent chromium, which contains as a catalyst a water-soluble pyridinium type compound, e.g., a five carbon atom heterocyclic ring compound containing a nitrogen atom in the ring and a proton on this nitrogen atom to constitute a nitrogenous positive ion together with sulfate, or halide ions constituting the negative ions in the bath. The sulfate and/or halogen salts are preferably in the form of addition compound with the cations of pyridinium, 2-methyl pyridinium, 3-methyl pyridinium, 4-methyl pyridinium, 2,4-dimethyl pyridinium, 2,6-dimethyl pyridinium trimethyl pyridinium, methyl ethyl pyridinium, quinolinium, methylquinolinium or acridinium.

3 Claims, No Drawings

ELECTROLYTIC CHROMIC ACID BATH FOR CHROME PLATING

CROSS REFERENCE TO RELATED APPLICATIONS

Applicant makes reference to the German Patent application Pat. No. 25 00 730.1, filed on Jan. 10, 1975, in the name of Bergische Metallwarenfabrik Dillenberg & Co. KG and priority is claimed under the provisions of 35 U.S.C. 119.

BACKGROUND OF THE INVENTION

1. Field of the Invention

The invention relates to the electrolytic precipitation of chromium from hexavalent chromium baths.

2. Description of the Prior Art

Great difficulties result in chomium plating whenever the object has a geometrically complicated shape, since in that case the current density is variable at the surface of the object that is to be chromium plated. At places at which only a low current density prevails, chromium plating is unsatisfactory, because of inadequate coating or no chromium plating at all occurs, whereas at places of very high current density, scorching, nodule formation or wart formation occurs. It is well known that in orcer to overcome these difficulties, conducting salts must be added to the chrome bath or catalysts must be added in the form of sulfates or fluorides or silicofluorides. It is also known that the concentrations and ratios of chromium trioxide and the individual conducting salts must be controlled within very narrow tolerances and further precise temperature control is required. Small tolerances must be maintained for both amounts and for the bath temperature. Beyond that, the deposition of chromium in the case of the known baths still depends very much on the critical proportions of trivalent chromium contained in the electrolytic, the concentration of which changes during the chrome plating process. Consequently, the known galvanic chrome baths must be constantly monitored and checked by means of quantitative analysis of the content of trivalent chromium, of sulfate, or fluoride, or of silicofluoride, and these must be regenerated correspondingly. As a result, the monitoring operation required for the bath is exceedingly expensive in time as well as in energy. Beyond that, chromium plating based on known chromium baths cannot be electrolytically precipitated in a lustrous form directly on to a support consisting of copper or copper alloy. Furthermore, hitherto, it has not been possible with the known crome baths in the case of intricately shaped objects to stainless steel, to fulfill simultaneously the requirements for a high scattering in depth and an avoidance of scorching in a practical and satisfactory manner.

To overcome these difficulties with regard to the formulation and monitoring of the bath, the scattering in depth, the avoidance of scorching, and based on the limited operational possibilities of chrome baths, numerous catalysts or regulating conducting salts have been proposed and used. It is known, for example, to add strontium sulfate to the chrome bath, which causes a self-regulating adjustment of the conductive content in case of a certain critical $CrO_3$ concentration. Furthermore, the sodium salt of the m-benzene disulfonic acid has also been used (German Pat. No. 1,008,542), in the case of which and due to the low degree of dissolution, and the low solubility at certain $CrO_3$ concentration, the optimum catalytic conductive content is supposed to adjust itself automatically. In the German published application No. 1,290,782, the addition of 25 to 100 grams per liter of a halogenate organic carboxylic acid with at least three carbon atoms has been described, as a result of which a scattering in depth and the luster of the precipitate as well as the stability of the bath are supported to be improved.

In the German published application No. 1,243,937, a chrome bath is given on the basis of Cr(VI) compounds which contains as a catalyst sulfuric acid as a sulfate ion producing compound and a sulfonated pyridine compound. By the addition of pyridine 3-sulfonic acid, the development of bumps or warts during the precipitation of thick chrome layers is said to be avoided. It is noted that the sulfonic acid is totally different in structure than a quaternary pyridine salt.

Dispite these additives, the known baths in the case of continuous use and operation require a practically daily quantitative analytic supervision and refilling. In addition, the scattering in depth of these known chrome baths is still capable of improvement.

SUMMARY OF THE INVENTION

The invention starts out from a galvanic chrome bath on the basis of Cr(VI) compounds to which is added a catalyst in the form of a sulfate ion supplying compound to which sulfuric acid or halide ions may be also added. The essential ingredient of the catalyst according to the invention is based on a heterocyclic hydrocarbon compound with five C atoms and one N atom in the ring and in the form of a positive ion, e.g. a cation of a quaternary salt.

The invention meets the basic requirement of providing a galvanic chrome bath with a self-regulating conductive salt which, while exhibiting a high scattering in depth e.g. throwing power, yet avoids scorching at coating sites or places of high current density, while requiring only a very simple operation of the bath at ordinary plating conditions and in case of which particular quantitative analyses of the components of the bath are not required and are superfluous. Beyond that, the bath according to the invention is suitable for the direct glossy and high lustrous precipitation of chromium on copper and copper alloy as well as on grotesquely shaped objects made of stainless steel.

Provision has been made according to one embodiment of the invention that the chrome bath contains a water-soluble sulfate of the heterocyclic hydrocarbon compound containing 5C and 1 N-atom in one ring as catalyst, in the case of which compound one proton is bound to the heterocyclic N atom. Such a chrome bath, containing only sulfate as a catalyst is suitable for the precipitation of chromium layers free of cracks.

For the standard chrome plating operation, which is also called macro-cracked chrome plating for micro-cracked chrome plating and also for hard chromium plating, the chrome bath according to the invention contains as a further or additional catalyst a water-soluble halogen compound of a heterocyclic hydrocarbon compound containing 5 C and 1 N atoms in one ring in the case of which the proton is bound to the heterocyclic compound.

OBJECTS OF THE INVENTION

An object of the invention is to provide a water-soluble N heterocyclic acid addition salt catalysts for electrolytic deposition of chromium in a hexavalent chromic acid bath containing sulfate ion and adapted for chrome plating, especially for fissure-free chrome plating or crack-free chrome plating.

A further object of the invention is to provide a watersoluble N heterocyclic acid addition salt catalyst as in the preceeding paragraph which exhibits superior coating characteristics and avoids the variability in current density during the plating of complex geometric shapes while overcoming the need for monitoring the concentration of chromium in the electrolyte.

A still further object of the invention is to provide a two catalyst mixture, one based upon the sulfate acid salt of the N heterocycle and the other based upon the halogen acid addition salt of such heterocycle, this mixture adapted especially for macro-fissured as well as for microfissured and for hard chrome plating.

A still further object of the invention is to provide a self-regulating catalyst comprising a water-soluble halogen acid addition compound of a N heterocyclic hydrocarbon containing 5 C atoms and 1 N-atom in a heterocyclic ring of compound and in which the N-atom has bound thereto the proton of the halogen acid.

Further and other objects will become apparent from the following general description of the operation and the specific examples.

GENERAL OPERATION

The one or the two catalysts, in the case of the invention, are added as special acid addition products, in the case of which after applying the required electrolytic voltage in the bath, a separation of the $SO_4^{--}$, or halogen ions takes place and a reformation of the free radical compound of the N heterocyclic hydrocarbon compound takes place, dependent upon the local current density in the cathode film of the object that is to be plated. This self-regulating catalyst effect is dependent upon the local current density and leads on the one hand to a great scattering in depth, and on the other hand to an aviodance of scorching while permitting great ranges of tolerance for the concentration at the individual plating components of the bath as well as a great range of tolerance for temperature.

This chromium bath of the invention turns out to be very sensitive vis-a-vis foreign matters located in the bath, such as iron, copper, zinc, and chlorine. The separation of chromium in the case of the invention is independent of the fact as to whether or not and how much trivalent chromium is present in the bath. As extensive tests have shown, the bath according to the invention requires only a very simple electrolytic operation of the bath.

In the case of a continuous use, all that is needed is a supervision once every two to three days of the contents of chromic acid by determination of the specific gravity of the bath with a spindle. A check of the catalyst content is done by means of the Hull cell and is needed only every three to four weeks. If, in the case of the Hull cell test, brown edges result in the low range of the current density, then the sulfate or sulfite component needs to be replenished. If, in the case of the Hull cell check scorching or milky grayish precipitations show in the area of high current density, then the halogen component is to be replenished. Because of the large ranges of tolerance, the dosing in of the catalysts can be accomplished relatively roughly. The electrolytic chemist familiar with the bath according to the invention is no longer dependent on a Hull cell check, since he is able to recognize early at the extreme geometrical places of grotesque objects whether or not and which catalyst component must be renewed.

DESCRIPTION OF THE PREFERRED EMBODIMENTS

According to the invention, the chrome bath can contain the sulfate, and/or halogen salt in the form of an addition compound formed with the N heterocycle, such as pyridinium, 2-methyl pyridinium, 3-methyl pyridinium, 4-methyl pyridinium, 2,4-dimethyl pyridinium, 2,6-dimethyl pyridinium, trimethyl pyridinium, methyl ethyl pyridinium, quinolinium, methylquinolinium or acridinium. The halogen salt can be the fluoride, silicofluoride, fluoroborate, chloride, chlorate, perchlorate, chlorite, bromide, bromate, iodide, or iodate of one or several of the previously mentioned heterocyclic hydrocarbon compounds and is similarly formed as an acid addition salt.

The above mentioned catalyst components can be produced simply from the pertinent heterocyclid hydrocarbon compounds and from sulfuric acid, sulfurous acid or the corresponding halogen acids, which are combined in stoichiometric quantities.

For the preferred catalysts, the structural formulas are given subsequently:

Pyridinium sulfate:

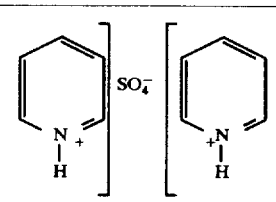

Pyridinium fluoride:

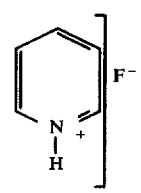

Pyridinium silicofluoride:

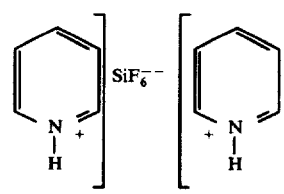

The preceding salts used as catalysts, therefore, always contain one or two pyridinium cations.

1. Crack-Free Chrome Plating Essential Components

In order to carry out a crack-free chrome plating, the bath contains, beside the aqueous solution of chromic acid, merely the sulfate salt and in a quantity which corresponds to a sulfate ion concentration of 1.1 to 3 grams per liter. According to a preferred composition, the bath intended for fissure-free chrome plating contains 190 to 450 grams per liter chromic acid and 2.8 to 7.0 grams per liter of pyridinium sulfate or. In the case of other pyridine-like compounds of higher molecular weight, larger quantities of catalyst salts are to be added in proportions corresponding to their higher molecular weight. Obviously, less pure salts can be assayed for purity and proportions adjusted.

2. Standard Chrome Plating Conditions

A chrome bath suitable for carrying out the standard chrome plating, (the macro-cracked chrome plating) according to the invention, contains the above sulfate and additionally halogen salt in a quantity which corresponds to a weight component of any one of 0.12 to 0.4 grams per liter fluoride ions or
0.18 to 0.6 grams per liter chloride ions or
0.30 to 0.8 grams per liter chlorite ions or
0.32 to 0.9 grams per liter chlorate ions or
0.36 to 1.1 grams per liter perchlorate ions or
0.32 to 0.9 grams per liter bromide ions or
0.40 to 1.2 grams per liter bromate ions or
0.40 to 1.2 grams per liter iodide ions or
0.45 to 1.3 grams per liter iodate ions or
0.07 to 0.2 grams per liter silicofluoride ions or
0.1 to 0.28 grams per liter fluoroborate ions.

Preferably, the bath intended for the standard chrome plating contains as a halogen salt 0.7 to 1.8 grams per liter pyridinium fluoride or a corresponding quantity by weight of pyridinium chloride, or of chlorate, or of perchlorate, or of chlorite, or of bromide, or of bromate, or of iodide, or of iodate. The complex salts are used in amounts such as 0.51 to 0.4 grams per liter pyridinium silicofluoride or pyridinium fluoroborate.

3. Micro-Cracked Chrome Plating Conditions

For the micro-cracked chrome plating, which is carried out in the case of a double chrome plating following the standard chrome plating, the invention preferably provides a bath which contains components a, $b_1$, or $b_2$ and ony one of the $c_1$ or $c_2$ series below:

a. 190 to 260 grams per liter chromic acid,
$b_1$. 2.8 to 3.9 grams per liter pyridinium sulfate or
$c_1$. 1.2 to 3.4 grams per liter pyridinium fluoride or a quantity of pyridinium chloride, -chlorate, -perchlorate, -bromide, -bromate, -iodide, -iodate equivalent thereto or
$c_2$. 0.15 to 0.21 grams per liter pyridinium silicofluoride or of pyridinium fluoroborate.

4. Hard Chromium Plating

For the hard chromium plating, the same chromium bath is used according to the invention as for the standard chromium plating, however with the one limitation that for the chromic acid a lower concentration limit of 350 grams per liter must be observed. Advantageously, the hard chromium plating is carried out at temperatures between 50° to 70° C and at a cathode current density between 25 to 70 A/dm$^2$.

EQUIVALENT ACRIDINE AND QUINOLINES

In all baths for chrome plating, one can use instead of the above mentioned pyridinium salts also the analogous acridinium and quinolinium salts, whereby again a larger quantity of catalyst salts must be added corresponding to their greater molecular weight.

COMPARISON OF CRACK-FREE, MICRO-CRACKED AND MACRO-CRACKED COATING

The baths for standard chrome plating and for micro-cracked chrome plating essentially differ only through the fact that in the latter case the upper limit of the chromic acid concentration is lower and the upper limit for the catalyst salts is also lower.

In the case of crack-free chrome plating, of the standard chrome plating and of the micro-cracked chrome plating, all of which can obviously be combined under the concept of decorative chrome plating, the processing conditions that must be observed are generally the same. For decorative plating, one can operate in a temperature range of 30° to 60° C, preferably 40° to 50° C, while the current density of the cathodes can fluctuate in a range from 2 to 30 A/dm$^2$, preferably 18 to 25 A/dm$^2$. The current efficiency amounts to between 25% to 35%. The time of decorative chrome plating is between 0.5 to 15 minutes.

Example 1: Crack-Free Chrome Plating

The following baths, according to the invention, achieve crack-free chrome plating:

| | | |
|---|---|---|
| 1a) | Pyridinium sulfate catalyst | |
| | Chromic acid | 260 grams per liter |
| | Pyridinium sulfate | 3.9 grams per liter |
| 1b) | Acridinium sulfate catalyst | |
| | Chromic acid | 400 grams per liter |
| | Acridinium sulfate | 7.4 grams per liter |

Each of these baths were used for several nickel-plated and several copper-plated, geometrically grotesque, objects. There were chrome plated at a bath temperature of 45° C and an average cathode current density of 20 A/dm$^2$, whereby between 0.5 and 15 minutes were needed for achieving a decorative brilliant lustrous crack-free chromium deposit. The chromium deposit had a Vicker's hardness between 800 and 1,000 VH, the current efficiency amounted to about 30%.

The scattering in depth of the bath was found with the Hull cell at a temperature of 45° C, at a current density of 20 A/dm$^2$, and an exposure time of 5 minutes and amounted to 80 mm.

Example 2: Standard Chrome Plating Using Two Component Catalysts

The following exemplify preferred baths:

| | | |
|---|---|---|
| 2a) | Mixed pyridinium sulfate and fluoride catalysts | |
| | Chromic acid | 260 grams per liter |
| | Pyridinium sulfate | 3.9 grams per liter |
| | Pyridinium fluoride | 1.1 grams per liter |
| 2b) | Mixed pyridinium sulfate and silicofluoride catalysts | |
| | Chromic acid | 260 grams per liter |
| | Pyridinium sulfate | 3.9 grams per liter |
| | Pyridinium silicofluoride | 0.18 grams per liter |
| 2c) | Mixed Acrylpyridinium sulfate and fluoride catalysts | |
| | Chromic aid | 400 grams per liter |
| | 3-Methylpyridinium sulfate | 5 grams per liter |
| | 3-methyl pyridiniium fluoride | 1.7 grams per liter |

Each of these baths are operated under the same conditions of the process as in the Examples 1 and 2, above. The deposited layers of chromium had a higher luster and had a Vicker's hardness of 1,200 to 1,500 VH. In the case of the check with the Hull cell, a scattering in depth of 95 mm resulted.

The above standard chrome plating baths, which use two catalysts, e.g., the pyridinium sulfate and fluoride or silicofluoride, provide a great scattering in depth together with an increase in the hardness, a combination of properties of great value.

Example 3: Micro-Fissured Chromium Plating Using Two Component Catalysts

The following exemplify preferred baths:

| | |
|---|---|
| 3a) | Pyridinium Sulfate and Fluoride Catalysts |

-continued

| | | |
|---|---|---|
| | Chromic acid | 210 grams per liter |
| | Pyridinium sulfate | 3.2 grams per liter |
| | Pyridinium fluoride | 1.4 grams per liter |
| 3b) | Pyridinium Sulfate and Silicofluoride Catalysts | |
| | Chromic acid | 210 grams per liter |
| | Pyridinium sulfate | 3.2 grams per liter |
| | Pyridinium silicofluoride | 0.15 grams per liter |

In the above examples of micro-fissured chromium plating using two catalysts, the second or halide catalyst, e.g., fluoride or silicofluoride catalyst is added in a considerably larger quantity which results in increased hardness of of the chromium deposit, this increased hardness resulting in small or micro-cracking of the deposited chromium layer after it is dipped in water, usually more than 400 cracks per centimeter. The scattering in depth is less than that in the Example 2 baths, and the present Example 3 baths are very useful for double chromium plating, e.g., a first plating with baths in Example 2 followed by micro-fissured plating in a bath under Example 3, to thereby achieve outstanding and superior corrosion-resistance.

OPERATION UNDER EXAMPLE 3

Objects, which previously had been standard chromium plated, were coated for 5 minutes with a micro-cracked chromium plating with these baths of Example 3 under the same previously mentioned processing conditions. In this case too, the objects had a spotless lustrous surface. The Vicker's hardness of the micro-cracked chromium deposits amounted to more than 1,500 VH. In the Hull cell check, we found a scattering in depth of 65 mm.

PERMISSIBLE VARIATIONS OF OPERATING CONDITIONS

As experiments carried out with the previously mentioned and with further examples of baths have shown, the bath temperature can fluctuate between 30° to 60° C, the mean cathode current density between 2 or 25 A/dm$^2$ and the concentration of the individual bath components in the case of the Examples 1 and 2, can fluctuate up to 50% upward or downward and in the case of the bath examples 3*a* and 3*b* up to 30% upward or downward as compared to the values given, without thereby impairing noticably the quality of the deposits. Preferably, however, in the case of the crack-free chrome plating, the standard chrome plating and the micro-cracked chrome plating, one operates within the temperature range of from 40° to 50° C and in a current density range from 18 to 25 A/dm$^2$.

Likewise, the content of trivalent chromium can fluctuate between 0 and 15%, related to the content of the bath of hexavalent chromium, without influencing the method of operation and the results of the chromium baths. In the case of a sufficiently large anode surface, which sould be approximately twice as large as the cathode surface, a content of trivalent chromium of about 1 to 2% appears, related to the content of hexavalent chromium.

Example 4: Hard Chromium Plating Using Two Component Catalysts

| | |
|---|---|
| Chromic acid | 420 grams per liter |
| Pyridinium sulfate | 3.9 grams per liter |
| Pyridinium fluoride | 1.1 grams per liter |

With this bath, thick, lustrous layers of chromium were deposited at temperatures varied between 50° to 70° C and at current densities varied between 25 to 70 A/dm$^2$ at a current efficiency between 25 to 35%, which layers even in the case of the high current densities show no scorching or warts. The separation speed lay between 0.2 to 1 micron per minute. The Vicker's hardness of the deposits amounted to 1,200 and 1,500 VH. In the Hull cell check, which was carried out in all cases under the same processing conditions as stated subsequently to the example of bath 2, a scattering in depth of 95 mm resulted.

The illustrative baths, which are illustrated in Example 4, above, provide results similar to those in Example 2, namely, they achieve a great scattering in depth of chrome plating coupled with an increase in hardness to produce superior coatings.

Also, like the baths in Example 2, the bath in Example 4, which employs two catalysts, relies upon the second catalyst, the halide such as pyridinium fluoride or pyridinium silicofluoride in increasing amounts to achieve proportionally higher values of scattering in depth so that these baths are uniquely adapted for the plating of irregularly shaped and complex shaped articles. In ordinary plating practice, the plating of such irregular articles does not achieve such great scattering in depth, and this unexpected result is wholly new and very desirable when coupled with the increased hardness.

From the above examples, it will be seen that the two basic objectives of the invention are achieved, namely, the simplification of catalyst addition for chrome plating in the unique form and dosage required, in a one catalyst or two catalyst system and meet the need for ease of selection of which system is required, the one catalyst system for simple objects or two catalyst system for complex objects and when a combination of both is needed, as for extremely high corrosion-resistance. These new objectives are achieved in a very simple manner since all of the catalyst cations have a common basic pyridine-type structure and all of the catalyst anions are sulfate in the one catalyst system, and either of these with halide anion in the two catalyst system. This simple addition of unique catalyst cation and anion species controls scattering in depth and hardness and handles a great number of requirements very effectively in a simple manner, which can be carried out by relatively unskilled personnel.

Having thus disclosed the invention, what is claimed is:

1. An electrolytic chromic acid bath for chromium plating consisting essentially of:

chromic acid in an amount of about 110 grams up to about 450 grams per liter;

a water soluble pyridinium, quinolinium or acridinium halide salt;

a water soluble pyridinium, quinolinium or acridinium sulfate salt;

said sulfate salt being present in an amount of at least 1.1 grams per liter up to about 7.0 grams per liter;

said halide salt being present when one of fluoride, chloride, bromide and iodide, in an amount of about 0.12 to 0.4 grams per liter of fluoride 0.18 to 0.6 grams per liter of chloride 0.32 to 0.9 grams per liter of bromide 0.40 l to 1.2 grams per liter of iodide; and said water soluble sulfate salt and water soluble halide salt regulating electroplating and providing a high throwing power and highly glossy coating while avoiding scorching at coating sites of high current density.

2. An electrolytic bath as claimed in claim 1 wherein said sulfate salt is pyridinium sulfate and is present in said bath at a concentration of about 2.8 grams to about 7.0 grams per liter.

3. An electrolytic bath as claimed in claim 2 wherein said halide catalyst is a pyridinium fluoride in an amount of 1.1 to 1.7 grams per liter.

* * * * *